US011627806B2

(12) United States Patent
Laiken et al.

(10) Patent No.: US 11,627,806 B2
(45) Date of Patent: Apr. 18, 2023

(54) PORTABLE CHAIR AND BLANKET ASSEMBLY

(71) Applicant: Lambs & Ivy, Inc., El Segundo, CA (US)

(72) Inventors: Michael Alan Laiken, Marina Del Rey, CA (US); Stephanie Elias, Los Angeles, CA (US); Daniel Arrin Garr, Los Angeles, CA (US); Jorge Gabriel Soto, Antioch, CA (US)

(73) Assignee: LAMBS & IVY, INC., El Segundo, CA (US)

( * ) Notice: Subject to any disclaimer, the term of this patent is extended or adjusted under 35 U.S.C. 154(b) by 0 days.

(21) Appl. No.: 17/553,644

(22) Filed: Dec. 16, 2021

(65) Prior Publication Data

US 2022/0192380 A1 Jun. 23, 2022

Related U.S. Application Data

(60) Provisional application No. 63/128,766, filed on Dec. 21, 2020.

(51) Int. Cl.
*A47C 4/52* (2006.01)
*A47C 13/00* (2006.01)
(Continued)

(52) U.S. Cl.
CPC ..... *A47C 1/024* (2013.01); *A47C 1/124* (2013.01); *A47C 1/14* (2013.01); *A47C 4/28* (2013.01); *A47C 7/62* (2013.01); *A45F 2004/026* (2013.01)

(58) Field of Classification Search
CPC ..... A47C 1/124; A47C 1/14; A47C 4/28
(Continued)

(56) References Cited

U.S. PATENT DOCUMENTS 241,748 A * 5/1881 Strauss ..... A47C 1/14 297/382
1,452,869 A * 4/1923 Cattier ..... A47C 4/14 297/118
(Continued)

FOREIGN PATENT DOCUMENTS

CN 105977648 B 10/2018
CN 110828964 A 2/2020
(Continued)

*Primary Examiner* — Rodney B White
(74) *Attorney, Agent, or Firm* — Douglas Denninger

(57) ABSTRACT

A portable chair assembly including first and second chairs and a movable support frame, each chair having a seat and a backrest. Each backrest is adapted (i) to be folded by a user onto its respective seat in a collapsed position and (ii) to be moved away from that seat into a deployed position. The support frame has at least two frame segments, each frame segment having an upper frame portion supporting one of the backrests at pivotable connections with the upper backrest portion of that backrest, and each frame segment being joined to the other frame segment by an upper joint member and a lower joint member. At least one angle member is provided per chair, a backrest end portion of each angle member being fixedly or removably secured to one of the first chair backrest and the second chair backrest, and a frame portion of each angle member restricting movement of the support frame away from the seats to establish a maximum deployment angle in the deployed position. A container, having an opening, is positioned between the first chair seat and the second chair seat. A blanket is placeable through the opening into the container to be stored therein in the collapsed position and deployable from the container in the deployed position.

15 Claims, 18 Drawing Sheets

(51) Int. Cl.

| | |
|---|---|
| ***A47C 4/28*** | (2006.01) |
| ***A47C 4/30*** | (2006.01) |
| ***A47C 4/32*** | (2006.01) |
| ***A47C 4/42*** | (2006.01) |
| ***A47C 1/024*** | (2006.01) |
| ***A47C 7/62*** | (2006.01) |
| ***A47C 1/14*** | (2006.01) |
| ***A47C 1/124*** | (2006.01) |
| *A45F 4/02* | (2006.01) |

(58) Field of Classification Search
USPC ..... 297/17, 129, 248, 118
See application file for complete search history.

(56) References Cited

U.S. PATENT DOCUMENTS 1,842,424 A * 1/1932 Ponten ..... A47C 1/146 297/440.11
2,570,571 A * 10/1951 Leeman ..... A47C 1/146 297/129 X
2,816,599 A * 12/1957 Adams ..... A45F 4/02 297/129 X
2,828,808 A * 4/1958 Hilton ..... A47C 4/52 297/129 X
2,868,274 A * 1/1959 Miller ..... A47C 1/146 297/129 X
2,913,073 A 11/1959 Wendling
2,915,154 A * 12/1959 Holder ..... A47C 4/52 297/17 X
3,092,224 A * 6/1963 O'Neil ..... A47C 1/146 297/17 X
3,404,915 A * 10/1968 Souza Filho De ..... A47C 4/52 297/17 X
3,475,050 A * 10/1969 Leahy ..... A47C 17/82 297/17 X
3,580,633 A * 5/1971 Du Priest ..... A47C 1/16 297/17
3,627,086 A * 12/1971 Caigan ..... A47C 5/005 297/17 X
3,808,616 A * 5/1974 White ..... A47C 1/146 5/722
3,929,373 A * 12/1975 Gawlinski ..... A47C 1/143 297/29
4,470,630 A 9/1984 Shields
4,530,451 A * 7/1985 Hamilton ..... A47C 4/52 224/155
4,654,907 A * 4/1987 Haugaard ..... A45C 3/10 297/17 X
4,733,905 A * 3/1988 Buickerood ..... A47C 13/00 297/129 X
4,749,209 A * 6/1988 Edmonds ..... A01K 97/22 297/129 X
5,016,792 A * 5/1991 Jay ..... A45F 4/02 297/17 X
5,042,874 A * 8/1991 Williams ..... A47C 4/52 297/17 X
5,087,095 A 2/1992 McFate
5,265,892 A * 11/1993 Said ..... B62B 1/20 297/129 X
5,289,958 A * 3/1994 Jay ..... A45F 4/02 297/129 X
5,356,197 A * 10/1994 Simic ..... A47C 13/00 297/129 X
5,395,157 A * 3/1995 Rollo ..... A47C 1/143 297/183.1
5,515,564 A * 5/1996 Lyons ..... A47C 1/14 5/639
5,529,375 A * 6/1996 English ..... A47C 1/124 297/40
5,588,570 A * 12/1996 Zirbel ..... A47C 1/146 297/129 X
5,701,979 A * 12/1997 Voich ..... A45F 4/02 297/129 X
5,882,079 A * 3/1999 Yang ..... A47C 20/027 5/419
5,951,103 A * 9/1999 Barnhill ..... A47C 1/143 297/440.1
6,104,358 A 8/2000 Parker et al.
6,250,712 B1 * 6/2001 Livington ..... A47C 1/146 297/17 X
6,375,200 B1 * 4/2002 Harter ..... B62B 1/12 297/129 X
6,773,059 B2 * 8/2004 Volotsenko ..... A61G 5/125 297/129 X
7,431,388 B2 10/2008 Sharapov
7,475,889 B2 * 1/2009 Marmah ..... A47C 1/14 297/129 X
7,591,032 B2 * 9/2009 Harrison ..... E04H 15/38 5/8
7,677,655 B2 * 3/2010 Marsh ..... B60N 2/3011 297/129 X
8,002,349 B1 * 8/2011 Pizzuto ..... A47C 1/143 297/188.05
8,074,324 B2 12/2011 Warren et al.
9,271,576 B2 * 3/2016 Loney ..... A47C 1/146
9,408,473 B2 8/2016 Sabina
9,681,764 B1 6/2017 Boynton
10,507,856 B1 * 12/2019 Malson ..... B62B 1/208
2005/0125894 A1 6/2005 Bandak
2007/0236055 A1 * 10/2007 Gausman ..... A47C 1/146 297/129
2012/0274103 A1 * 11/2012 Kenttamaa-Squires ..... A47C 1/035 297/129 X
2016/0008689 A1 * 1/2016 Janeri ..... A47C 4/08 273/402
2016/0183696 A1 * 6/2016 Kuusela ..... A47D 11/00 297/129
2018/0228294 A1 * 8/2018 Beaulieu ..... A47C 4/28
2019/0090667 A1 3/2019 Mason et al.
2019/0335702 A1 11/2019 Thrift et al.
2022/0175140 A1 * 6/2022 Lee ..... A47C 1/026

FOREIGN PATENT DOCUMENTS

DE 4233398 A1 * 4/1994 ..... A47C 13/00
DE 20306179 U1 * 7/2003 ..... A47C 1/14
DE 20314839 U1 * 11/2003 ..... A47C 1/14
DE 10317630 B3 * 10/2004 ..... A47C 1/14
DE 202006019292 U1 * 5/2008 ..... A47C 1/14
FR 2938280 A1 5/2014
WO WO-2000-074963 A1 12/2000

* cited by examiner

PORTABLE CHAIR AND BLANKET ASSEMBLY

CROSS-REFERENCE TO RELATED APPLICATION

This application claims priority to U.S. provisional patent application No. 63/128,766 filed 21 Dec. 2020. The entire contents of the above-mentioned application are incorporated herein by reference.

FIELD OF THE INVENTION

This invention relates to assemblies having folding chairs plus a blanket and more particularly to such assemblies which are collapsible and readily portable by a single person.

BACKGROUND OF THE INVENTION

A common situation faced by couples and families when venturing outside is finding comfortable seating in a selected outdoor location. Sitting directly on the ground can result in grass and/or soil stains on clothing, as well as feeling hard and/or cold. Depending on weather conditions, shade from the sun may be desired for a period of time. When younger children are present, they may prefer to play on the ground rather than sit still in a chair.

Various attempts at portable seating include a foldable combination chairs and table disclosed in U.S. Pat. No. 5,951,103 by Barnhill. A beach mat, chair and shelter combination is described by Bandak in U.S. Patent Application Pub. No. 2005/0125894 A1. Sabina discloses a portable sun-shaded folding chair in U.S. Pat. No. 9,408,473.

It is therefore desirable to have a convenient, easily collapsible and readily portable chair and blanket assembly suitable for use by two or more people.

SUMMARY OF THE INVENTION

An object of the present invention is to provide a portable chair and blanket assembly that accommodates two or more people while being relatively easy to set up, to collapse, and to be carried by a single person.

Another object of the present invention is to provide such an assembly that may include a readily deployable hood to serve as a sunshade.

This invention features a portable chair and blanket assembly including first and second chairs with a support frame that is movable relative to the chairs. Each chair has a seat and a backrest, each backrest having an, upper backrest portion and a lower backrest portion. Each backrest is adapted (i) to be folded by a user onto its respective seat in a collapsed position and (ii) to be moved away from that seat into a deployed position such that a person can place at least a portion of his/her back on the backrest for one of the chairs while sitting on the seat for that chair. The support frame has at least two frame segments, each frame segment having an upper frame portion supporting one of the backrests at pivotable connections with the upper backrest portion of that backrest, and each frame segment being joined to the other frame segment by an upper frame joint member and a lower frame joint member. At least one angle member accompanies each chair, at least one backrest end portion of each angle member being secured to one of the first chair backrest and the second chair backrest, and a frame portion of each angle member restricting movement of the support frame away from the seats to establish a maximum deployment angle in the deployed position. The assembly further includes a container having an opening and being positioned between the first chair seat and the second chair seat. A blanket is placeable through the opening into the container to be stored therein in the collapsed position and is deployable from the container in the deployed position.

In one embodiment, at least one of the angle members includes a loop of fabric having two backrest end portions attached to one of the backrests and a bight of the loop of fabric forming the frame portion of that angle member. In another embodiment, each angle member is adjustable to change the maximum deployment angle.

In some embodiments, at least one carry strap extends proximate to the container to enable a user to carry the assembly in the collapsed position utilizing the at least one carry strap. In certain constructions, one or two straps are connected to the container, which may be a carry case with a zipper or a stuff sack having an adjustable closure for the opening. In some constructions, the container is attached to an edge of each of the first chair seat and the second chair seat.

In one embodiment, the lower backrest portion of each backrest for each chair is bendably attached to a portion of the seat for that chair. In some embodiments, each backrest includes at least one stiffener, and a majority of each of the chairs is formed of a flexible fabric. In certain embodiments, the upper and lower frame joint members enable each frame segment to be folded to occupy a plane that is substantially parallel to a plane occupied by the other frame segment. In one embodiment, the frame joint members establish a center frame span having a center frame length, and the container has a width that is substantially the same as the center frame length. Some embodiments further include a single hood having material extending between a front hood frame member and a rear hood frame member, each hood frame member having a center hood joint, a left-side hood joint and a right-side hood joint, and each hood frame member being pivotably connected to each of the frame segments to provide shade or rain protection over both chairs as desired by the users.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

This invention may be accomplished by portable chair assembly including first and second chairs, each chair having a seat and a backrest. Each backrest is adapted (i) to be folded by a user onto its respective seat in a collapsed position and (ii) to be moved away from that seat into a deployed position such that a person can place at least a portion of his/her back on the backrest for one of the chairs while sitting on the seat for that chair. The assembly further includes a support frame having at least two frame segments, each frame segment having an upper frame portion supporting one of the backrests at pivotable connections with the upper backrest portion of that backrest, and each frame segment being joined to the other frame segment by an upper frame joint member and a lower frame joint member. At least one angle member is provided per chair, a backrest end portion of each angle member secured to one of the first chair backrest and the second chair backrest, and a frame portion of each angle member restricting movement of the support frame away from the seats to establish a maximum deployment angle in the deployed position. A container, having an opening, is positioned between the first chair seat and the second chair seat. Preferably, at least one carry strap extends proximate to the carry case to enable a user to carry the assembly in the collapsed position utilizing the at least one carry strap. A blanket is placeable through the opening into the container so that the blanket can be stored therein in the collapsed position and deployable from the container in the deployed position.

The term "chair" as utilized herein includes an apparatus having at least a seat and a backrest. In some constructions, the seat has a lower surface which rests directly on ground.

The term "ground" as utilized herein includes lawns, beaches, floors, and any other natural or man-made surface upon which a chair can be placed.

The term "portion" as utilized herein refers to a section or region of a component, without necessarily indicating any physical difference between two or more portions apart from location such as "upper portion" and "lower portion".

Figure 1:
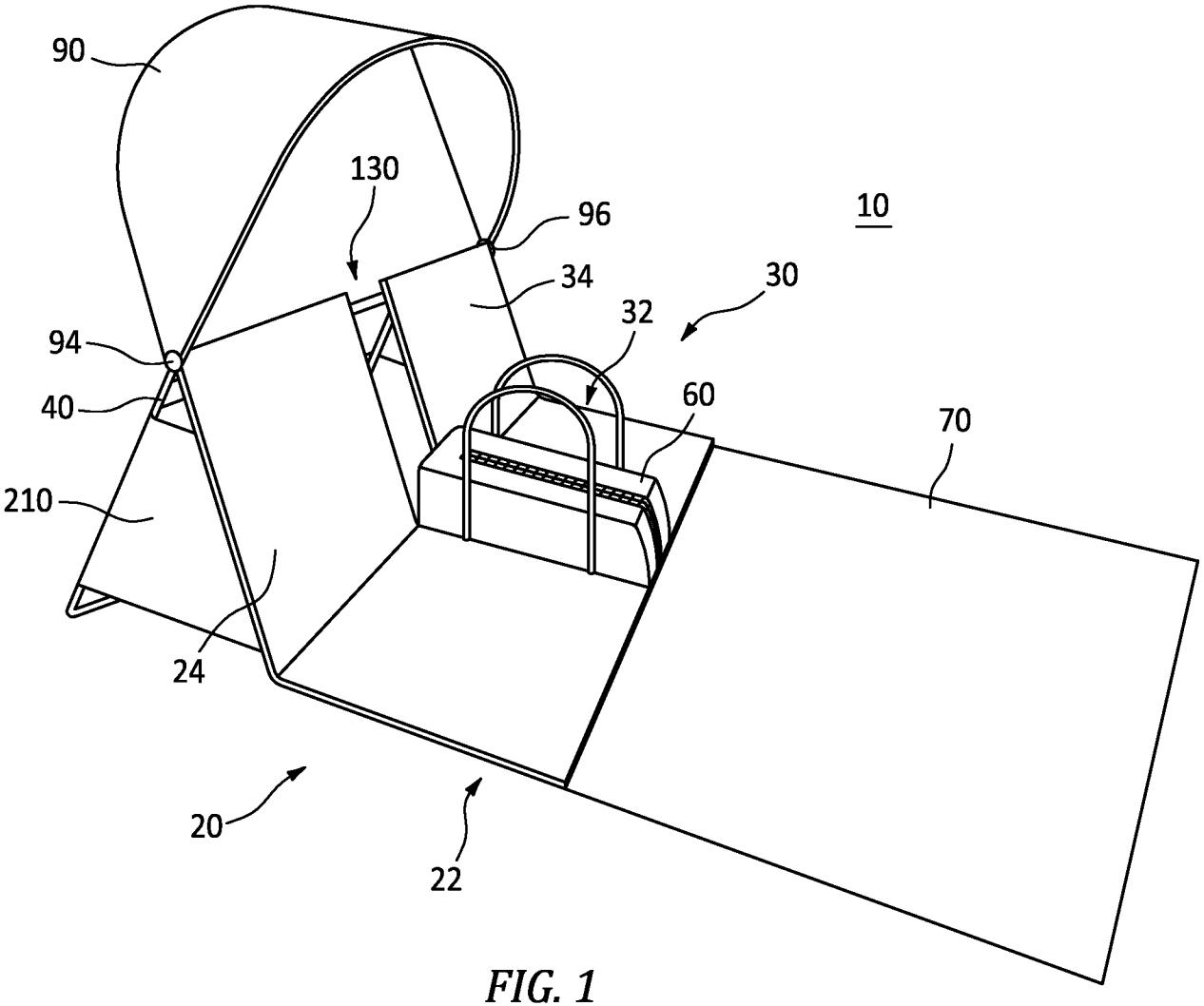
FIG. 1 is a schematic front right-side perspective view of an assembly according to the present invention in a fully-deployed position with two chairs, a sun-shade hood, a carrying case serving as a container and a blanket withdrawn from the carrying case.
Figure 2:
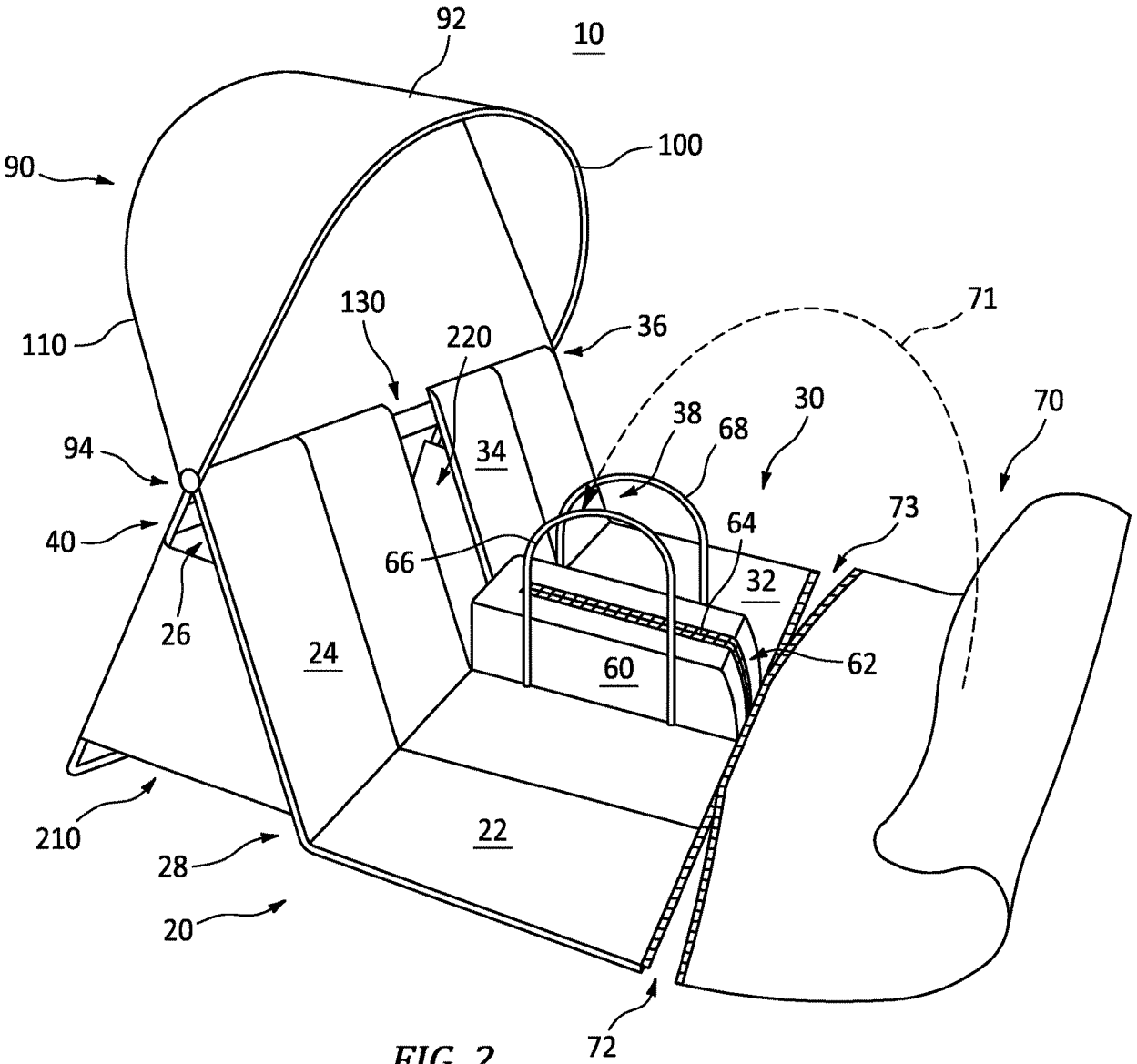
FIG. 2 is a schematic perspective view similar to FIG. 1 with the blanket being detached from the chairs by unzipping.

A chair assembly 10, FIGS. 1 and 2, has a first chair 20 and a second chair 30, a support frame 40, a container 60 such as a zippered carrying case, and a blanket 70. A hood 90 is also included in some constructions, as described in more detail below, and is movable between at least one deployed hood condition and at least one collapsed hood condition. Each chair 20, 30 has a seat 22, 32 and a backrest 24, 34. Each backrest 24, 34 has an upper backrest portion 26, 36 and a lower backrest portion 28, 38, FIG. 2. Each backrest 24, 34 is adapted (i) to be folded by a user onto its respective seat 22, 32 in a collapsed position, such as described below in relation to FIGS. 5-6D, and (ii) to be, moved away from that seat into a deployed position, FIG. 1, such that a person can place at least a portion of his/her back on the backrest for one of the chairs while sitting on the seat for that chair.

Figure 5:
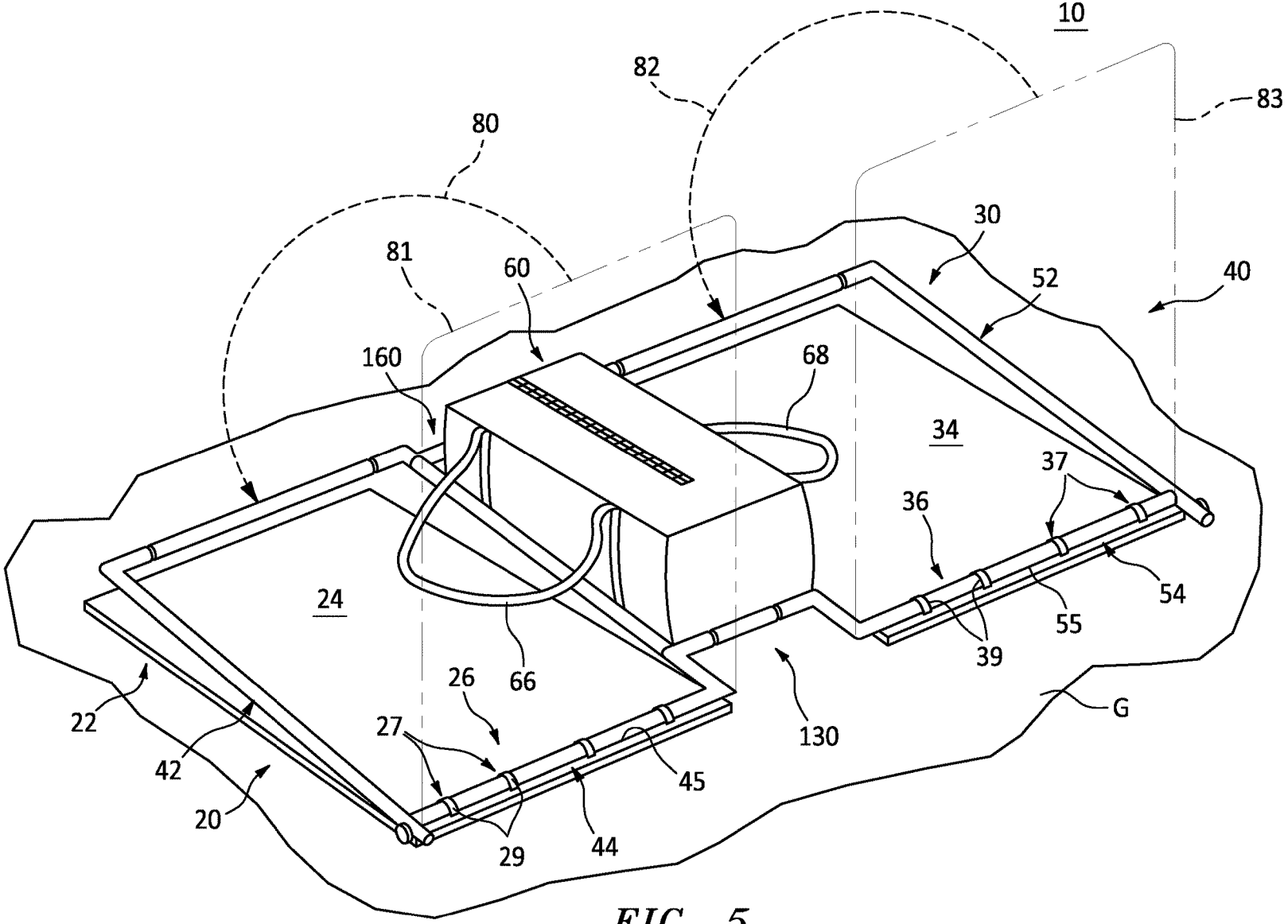
FIG. 5 is a schematic perspective view of the assembly of FIG. 4 without the hood and after the chairs are collapsed.

The support frame 40 has at least two frame segments 42, 52, FIG. 5, each frame segment 42, 52 having an upper frame portion 44, 54 supporting respective upper backrest portions 26, 36 at pivotable connections 27, 37. In this construction, the pivotable connections 27, 37 include fabric loops 29, 39 attached on each of their ends to upper backrest portions 26, 36, respectively, through which upper frame pieces 45, 55 are passed before assembling with the remainder of the frame segments 42, 52 in one construction and, in another construction, the fabric loops 29, 39 are secured over fully assembled frame segments 42, 52. In some constructions, a continuous piece of material forms each set of loops 29, 39, such as excess material of backrests 24, 34 each forming a single passage for frame pieces 45, 55. In yet other constructions, the pivotable connections 27, 37 include one or more polymeric loops or other elements defining one or more passages for the frame pieces 45, 55.

Figure 7:
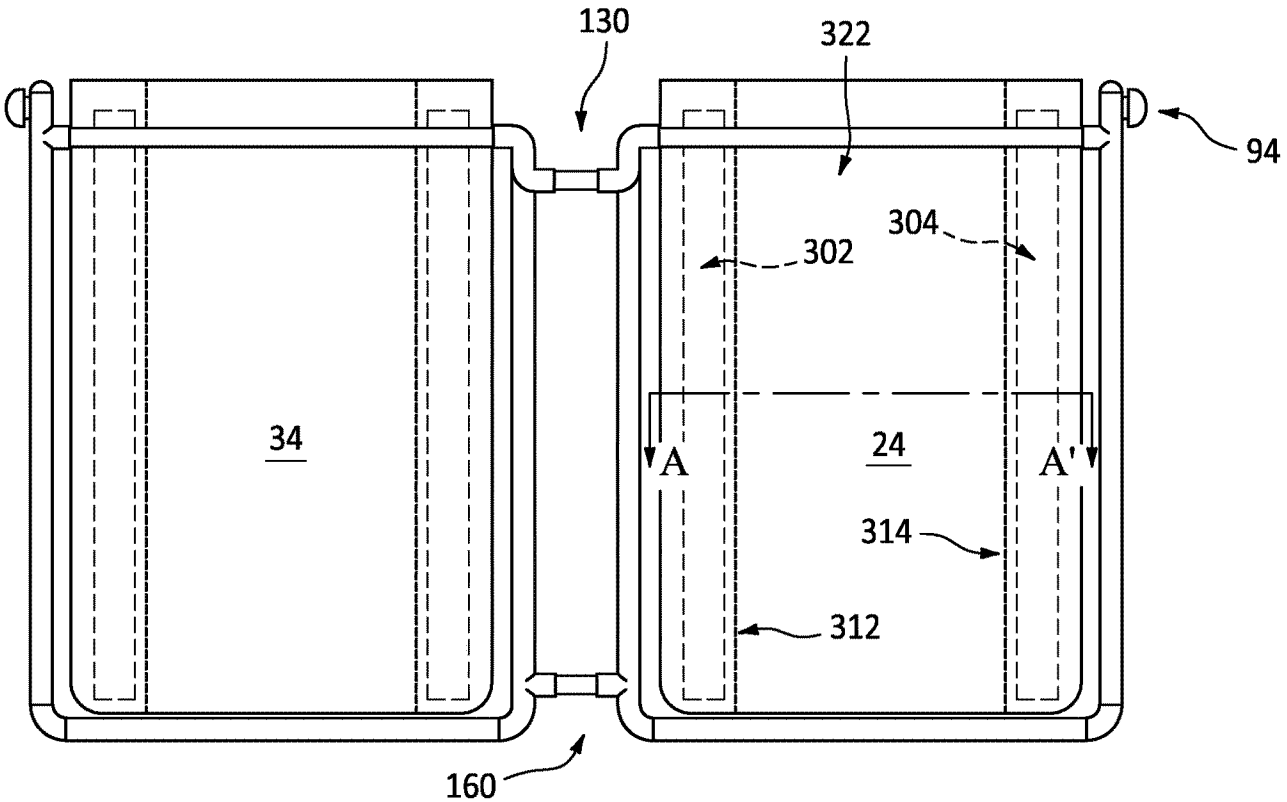
FIG. 7 is a schematic top plan view of the assembly of FIG. 5 with the carrying case removed for illustration purposes and showing one embodiment of the backrests with reinforcement inserts.
Figure 8:
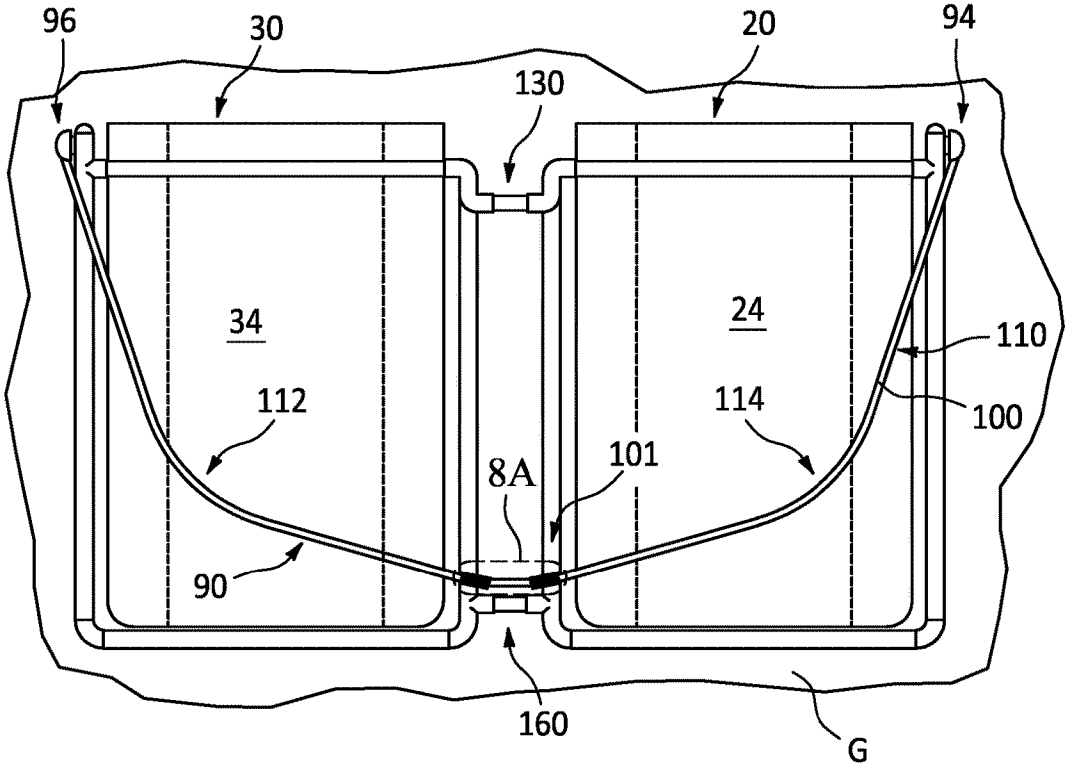
FIG. 8 is a view similar to FIG. 7 showing a hood collapsed against the chairs.

Frame segments 42, 52 are joined to each other by an upper frame joint member 130 and a lower frame joint member 160, such as shown in FIGS. 7 and 8, and discussed in more detail below. In the construction shown in FIGS. 1-2, two angle members 210, 220 are provided per chair, as described below beginning with FIG. 10.

Figure 3:
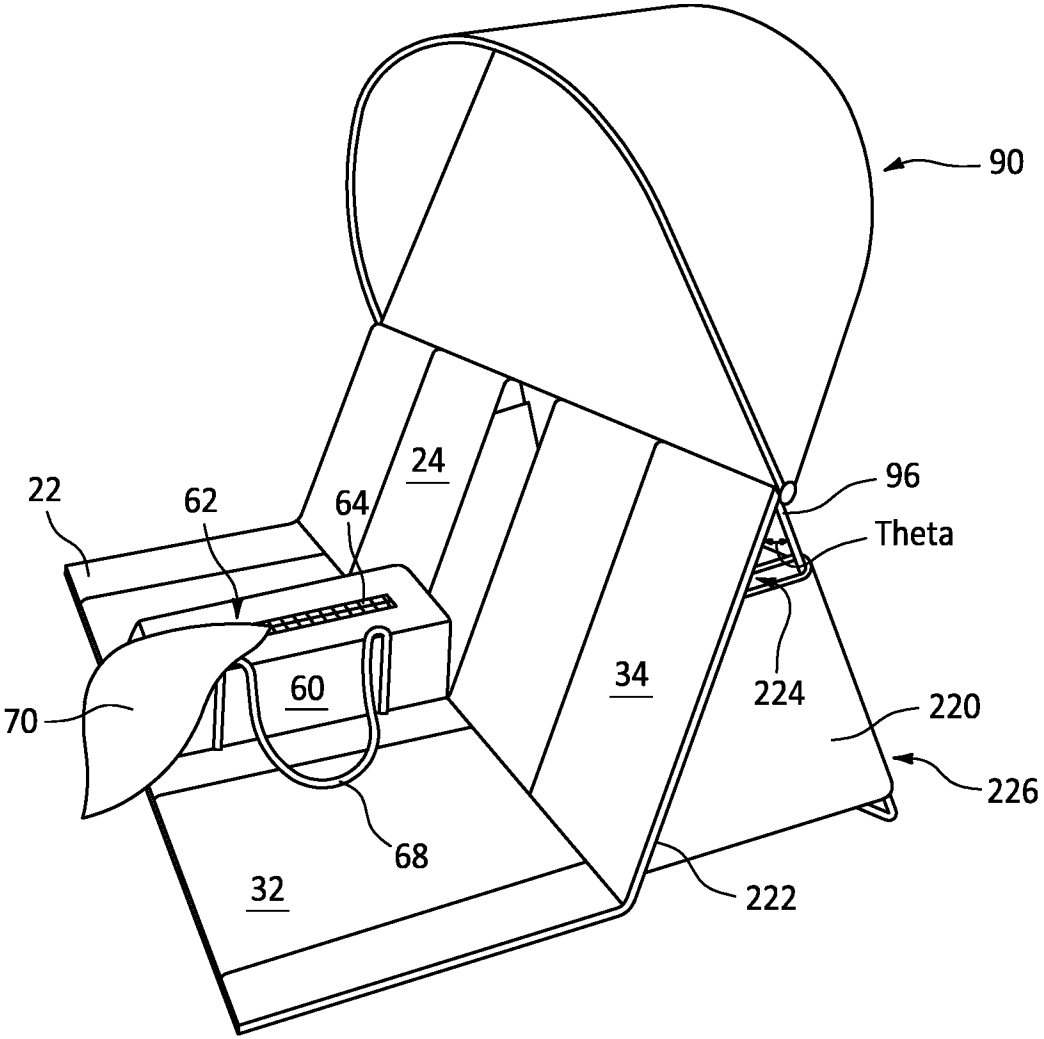
FIG. 3 is a schematic perspective left-side view of the assembly of FIGS. 1-2A with the blanket fully detached and being stuffed into the carrying case.

The container 60, FIGS. 2 and 3, has an opening 62 which is selectively exposed when a user opens or closes the container 60 utilizing a closure member such as zipper 64. In other constructions, such as when a stuff sack is provided as the container 60, other closure members such as hook-and-loop fasteners or draw strings can be utilized. Container 60 is positioned between the first chair seat 22 and the second chair seat 32. At least one carry strap 66, 68 extends proximate to the container 60.

The blanket 70 is placeable through the opening 62 into the container 60 to be stored therein in the collapsed position, as described in more detail below beginning with FIG. 3, and is deployable from the container 60 in the deployed position such as shown in FIG. 1.

In the construction illustrated in FIGS. 1-4 and described in more detail below beginning with FIG. 8, assembly 10 further includes hood 90 having material 92 extending between a front hood frame member 100 and a rear hood frame member 110. The hood frame members 100 and 110 each have opposing ends pivotable on hinges 94 and 96.

Figure 2B:
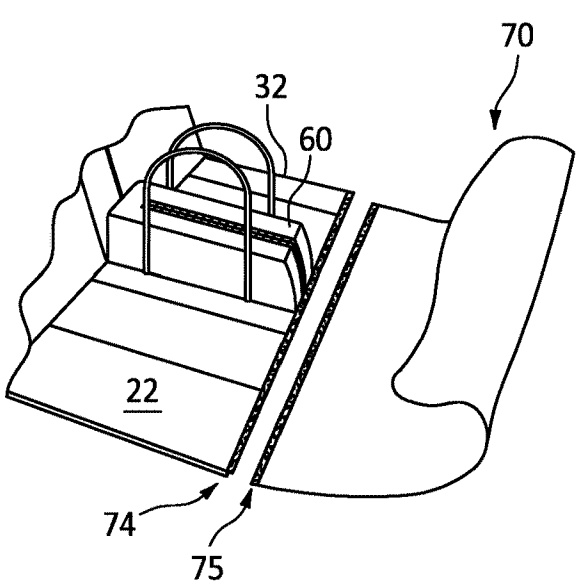
FIGS. 2B and 2C are views similar to FIG. 2A showing alternative fasteners of VELCRO hook-and-loop and snaps, respectively.
Figure 2C:
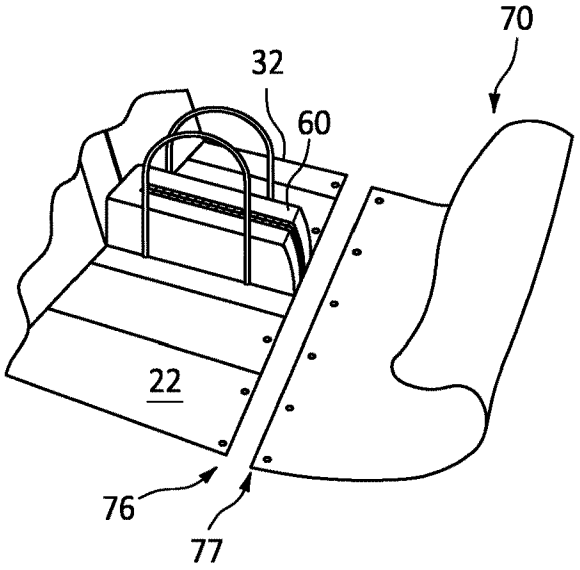
Figure 2A:
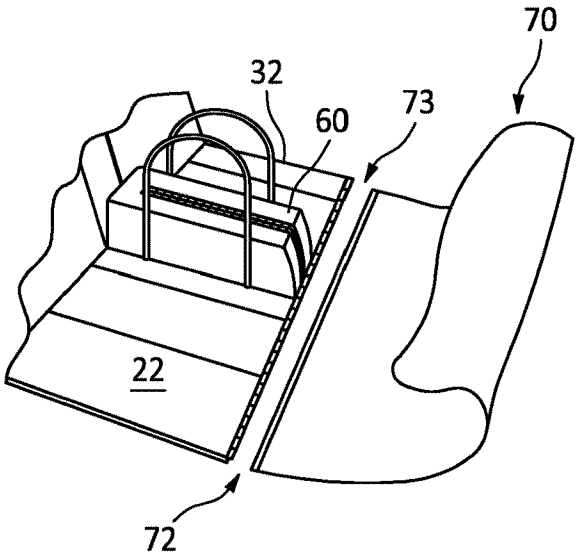
FIG. 2A is a view of a portion of FIG. 2 showing the blanket fully unzipped from the chairs.

As mentioned above, assembly 10 according to one construction of the present invention is shown in FIG. 1 in a fully-deployed position with the blanket 70 fully withdrawn from the container 60. When a user desires to collapse the assembly 10 for transport and/or storage, the blanket 70 is partially or fully detached from the seats 22 and 32, FIG. 2, as indicated by zippers 72 and 73, and then rolled or gathered and placed into the container 60 as indicated by dashed arrow 71. Blanket 70 is shown fully unzipped from seats 22, 32 in FIG. 2A. Reference numerals 72 and 73 represent two separate zipper mechanisms in one construction and, in another construction, represent two mating teeth sections of a single zipper mechanism that extends along the entire edge of blanket 70. FIGS. 2B and 2C are views similar to FIG. 2A showing alternative fasteners of VELCRO hook-and-loop 74 and 75, and snaps or toggles/grommets 76 and 77, respectively. The blanket 60 is shown in FIG. 3 fully detached and mostly stuffed into the container 60.

Figure 4:
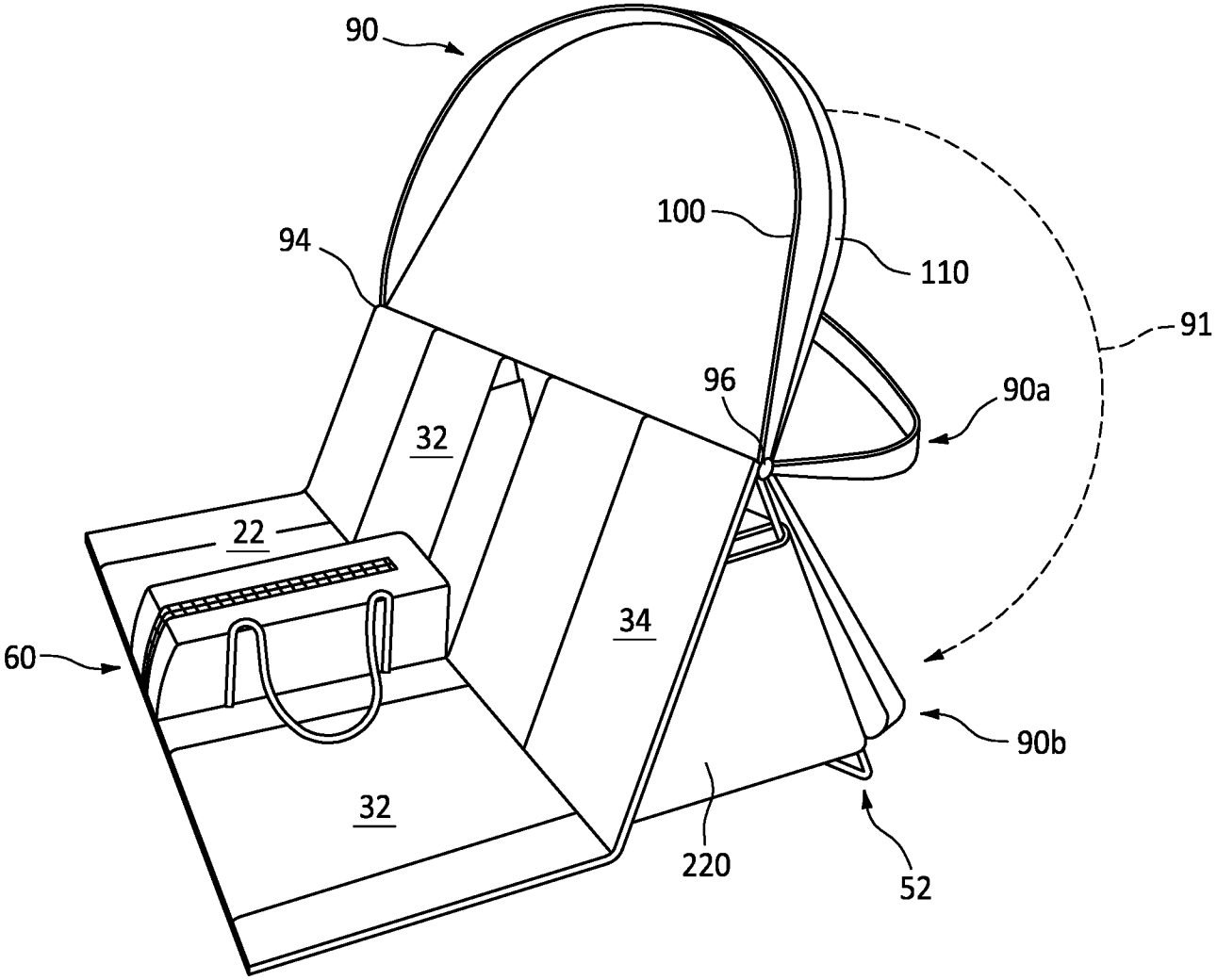
FIG. 4 is a schematic perspective view of the assembly of FIG. 3 with the hood becoming collapsed when shade is not needed or for transport.

Before or after the blanket 60 is stored in container 60, the hood 90 is collapsed as indicated by dashed arrow 91, FIG. 4, when shade is not needed or for transport and/or storage. An intermediate collapsed position is indicated by 90*a* and a further collapsed position against frame segment 52 is indicated by 90*b*.

Arrows 80 and 82, FIG. 5, show the chairs 20, 30 collapsed for transport with frame segments 42, 52 being collapsed on top of the backrests 24, 34 as indicated by dashed arrows 80, 82. Dashed lines 81 and 83 represent deployed positions for frame segments 42, 52 relative to backrests 24, 34 prior to collapsing. At this stage in folding as shown in solid lines, all of seats 22, 32, backrests 24, 34 and frame segments 42, 52 lie along a single plane relative to ground G.

Figure 6A:
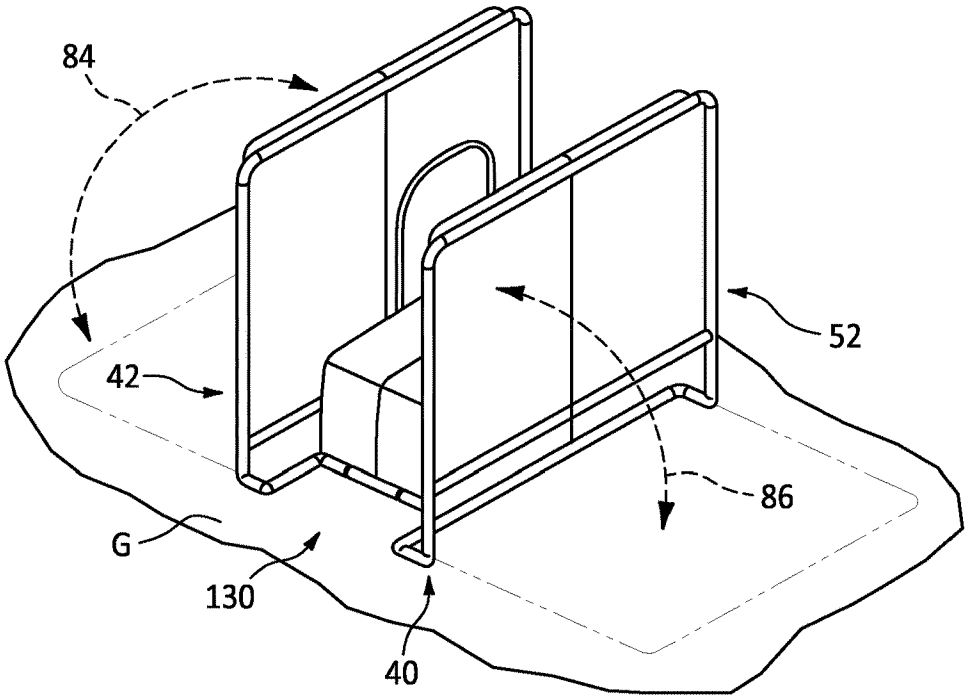
FIG. 6A is a schematic perspective view of the assembly of FIG. 5 placed into an inward transport position.
Figure 6B:
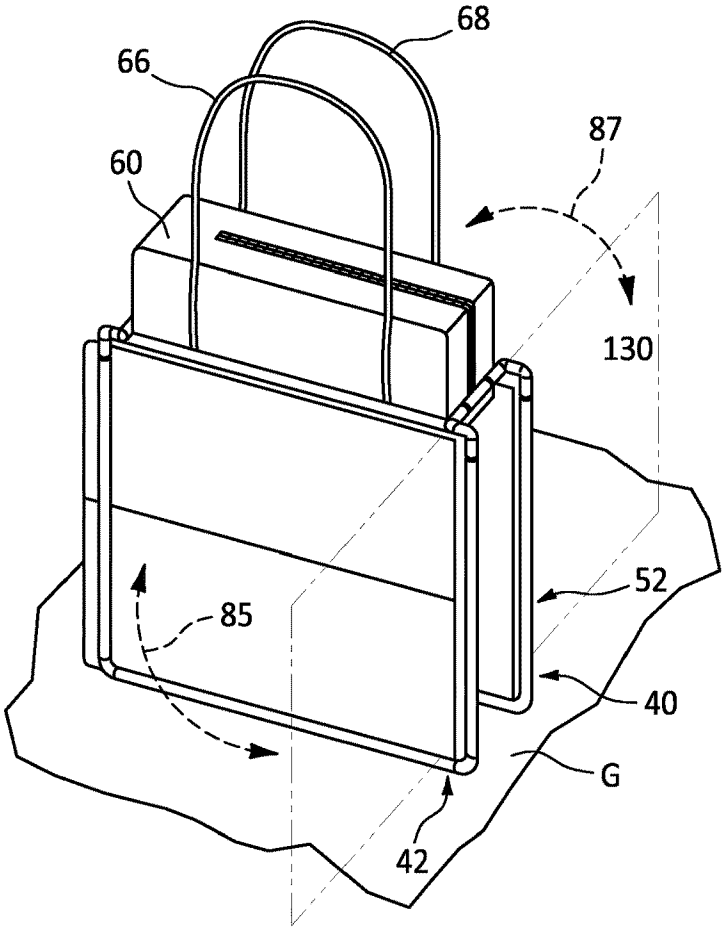
FIG. 6B is a schematic perspective view of the assembly of FIG. 5 placed into a outward transport position.
Figure 6D:
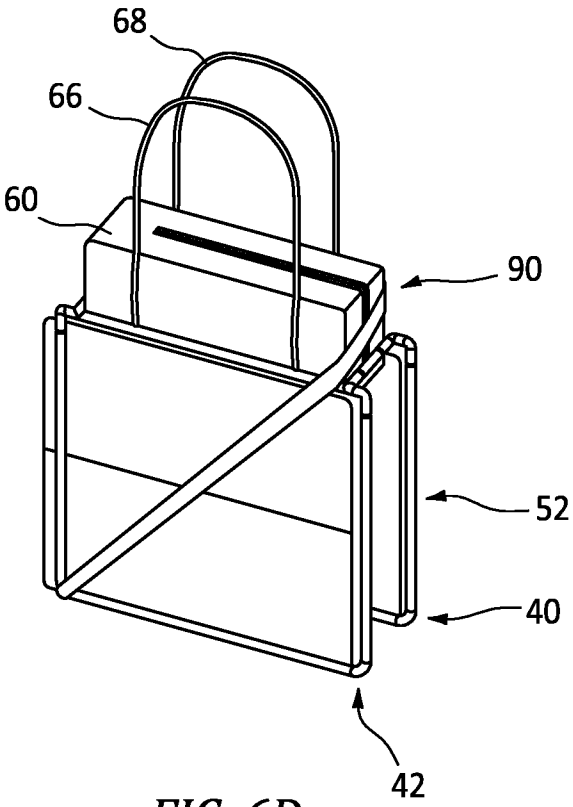
FIGS. 6C and 6D are views similar to FIG. 6B showing the hood of FIG. 4 in different collapsed positions.
Figure 6C:
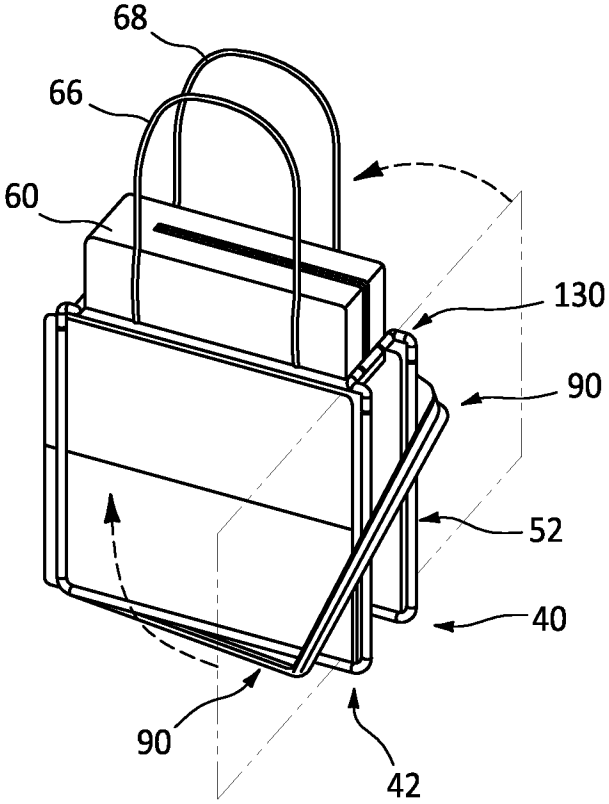

Several final transport and/or storage positions are possible according to the present invention. FIG. 6A shows the assembly 10 of FIG. 5 placed into an inward transport position in which the upper and lower frame joint members 130, 160 enable each frame segment 42, 52 to be folded, dashed arrows 84 and 86, to occupy a plane that is substantially parallel to a plane occupied by the other frame segment. Both planes are perpendicular to, and extend above, the plane of ground G which is occupied by the frame joint members 130, 160. By comparison, an outward transport position, FIG. 6B, has frame joint members 130, 160 lifted away, dashed arrows 85 and 87, from the plane of ground G to fold the each of frame segments 42, 52 to occupy a plane that is substantially parallel to a plane occupied by the other frame segment. Hood 90, FIGS. 1-4, is optional and is not shown in FIGS. 5-6B; different collapsed hood positions for hood 90 are illustrated in FIGS. 6C and 6D as non-limiting examples for storage and/or transport.

Figure 7B:
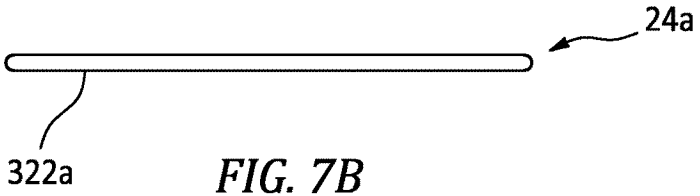
FIG. 7B is a schematic cross-sectional view similar to FIG. 7A showing an alternative backrest made of fabric without an insert.
Figure 7A:
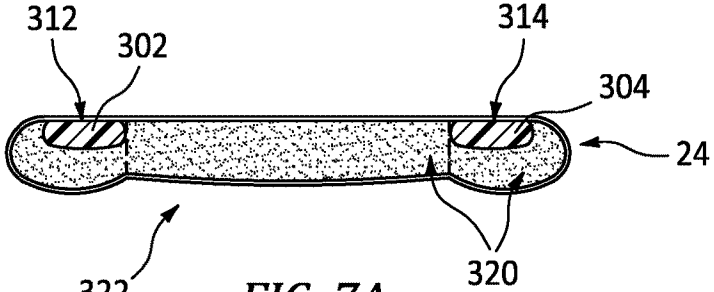
FIG. 7A is a cross-sectional view along lines A-A' in FIG. 7.

FIG. 7 is a schematic top plan view of the assembly of FIG. 5 with the carrying case removed for illustration purposes and showing one embodiment of the backrests with reinforcement inserts 302, 304 residing within pockets 312 and 314. FIG. 7A is a cross-sectional view along lines A-A' in FIG. 7 showing inserts 302, 304 within pockets 312, 314 plus filling 320 serving as padding for backrest 24 when encased within outer fabric 322. An alternative backrest 24*a*, FIG. 7B, is made solely of fabric 322*a* without an insert.

FIG. 8 is a view similar to FIG. 7 showing hood 90 collapsed against the chairs 20, 30 and lying flat along ground G. Material 92 of hood 90 is collapsed between front hood frame member 100 and rear hood frame member 110. Each hood frame member 110, 110 has a center hood joint 101, a left-side hood joint 112 and a right-side, hood joint 114. Each hood frame member 100, 110 is pivotably connected to each of the frame segments by hinges 94 and 96 in this construction. Hinges utilized to pivotably attach adjustable hoods to many conventional baby strollers, for example, are suitable for hinges 94 and 96.

Figure 8A:
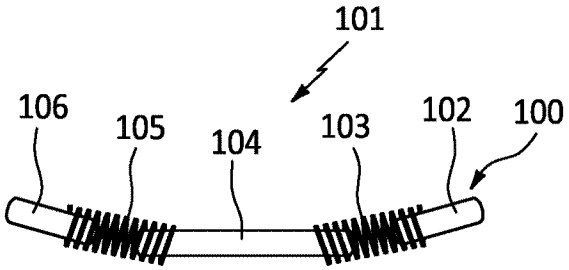
FIG. 8A is a schematic enlargement of a portion of FIG. 8 showing rigid rods with springs in the center portion of the hood.

FIG. 8A is a schematic enlargement of a portion of FIG. 8 showing center rigid rod 104 connected by springs 103 and 105 to lateral rods 102 and 106, respectively, in the center hood joint portion 101 of each of the hood frame members 100 and 110.

Figure 9:
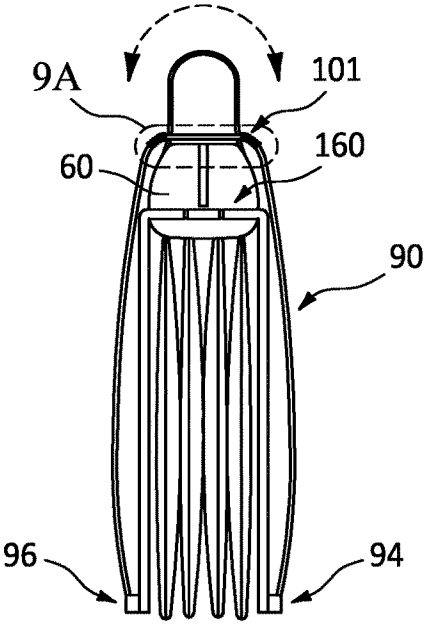
FIG. 9 is a schematic side view of the assembly of FIG. 8 placed in an outward transport position with the center of the hood positioned above carrying case.
Figure 9A:
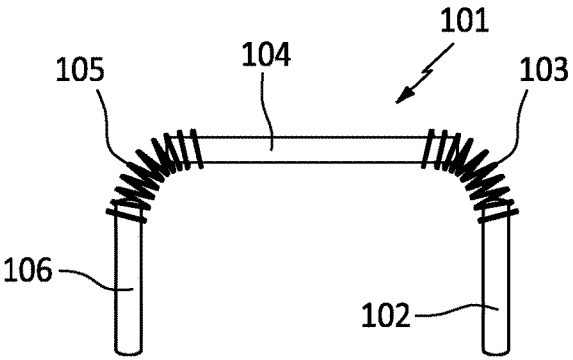
FIG. 9A is a schematic enlargement of a portion of FIG. 9 showing two of the rigid rods bent at a greater angle relative to a center rod.
Figure 9B:
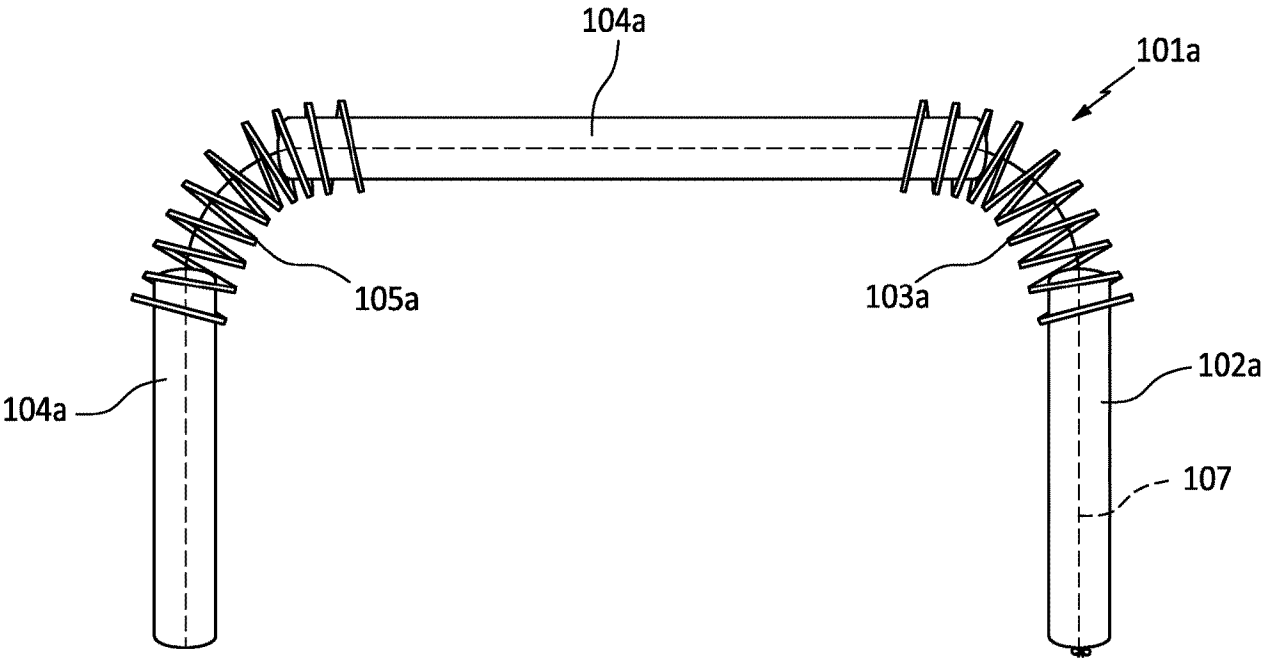
FIG. 9B is a view similar to FIG. 9A showing the alternative embodiment having the elastic cord.
Figure 9C:
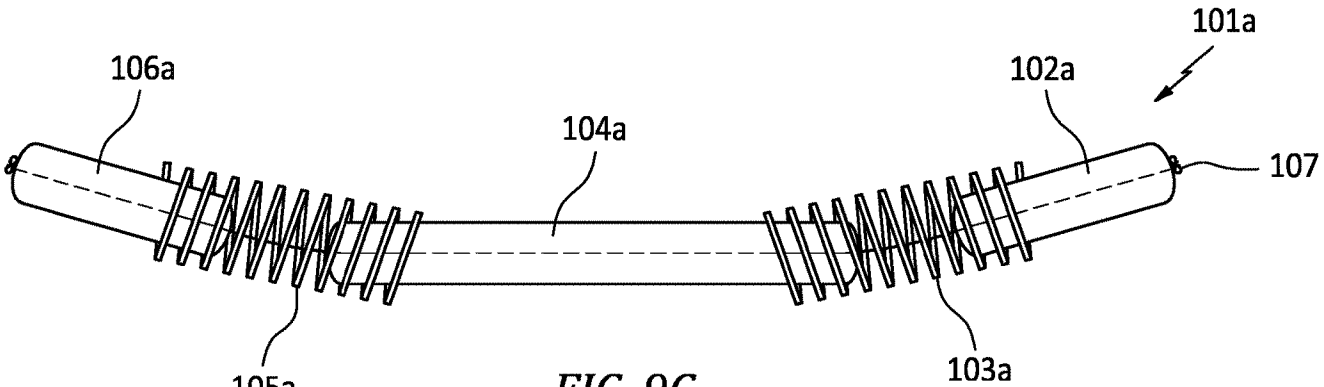
FIG. 9C is a view similar to FIG. 8A showing the alternative embodiment having an elastic cord extending through the rods and springs.

FIG. 9 is a schematic side view of the assembly of FIG. 8 placed in an outward transport position, such as described above in relation to FIGS. 6B-6D, with the center of the hood 90 positioned above carrying case 60. FIG. 9A is a schematic enlargement of a portion of FIG. 9 showing two of the rigid rods bent at a greater angle relative to a center rod relative to the collapsed flat condition shown in FIGS. 8-8A. FIG. 9B is a view similar to FIG. 9A showing the alternative embodiment having the elastic cord 107 extending through center hood joint portion 101*a*. FIG. 9C is a view similar to FIG. 8A showing the alternative embodiment for center hood joint portion 101*a* having the elastic cord serving as an optional tension member 107 extending through the rods and springs. Yet another alternative joint construction is described below in relation to FIGS. 16A-16B.

In the construction shown in FIGS. 1-3, two angle members 210, 220 are provided per chair, with first and second backrest end portions such as end portions 222 and 224, FIG. 3, for angle member 220, secured to backrest 34. A frame portion 226 of each angle member restricts movement of the support frame 40 away from the seats 22, 32 to establish a maximum deployment angle THETA in the deployed position.

Figure 10:
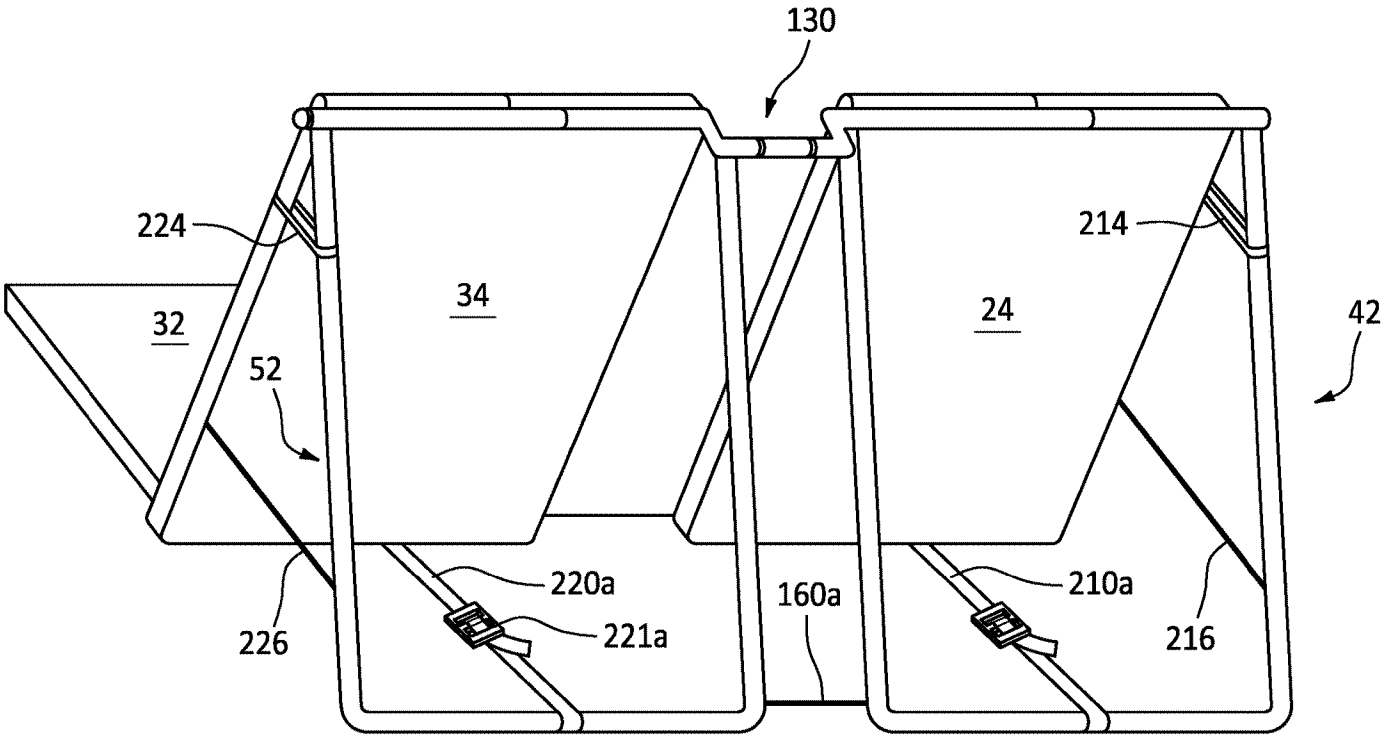
FIG. 10 is a schematic rear perspective view of an alternative embodiment of a chair assembly with straps instead of fabric angle members.
Figure 10A:
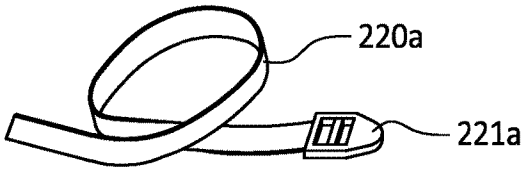
FIG. 10A is a perspective view of an example of a strap with buckle shown in FIG. 10.

By comparison, an alternative embodiment of a chair assembly is illustrated in FIG. 10 with adjustable angle straps 210*a*, 220*a* instead of fabric angle members. An adjustable closure member such as buckle 221*a*, FIG. 10A, enables the maximum deployment angle to be decreased as desired. In this construction, upper retainer cords 214, 224 and lower retainer cords 216, 226 prevent rearward movement of frame segments 42, 52 beyond a maximum angle.

Figure 11A:
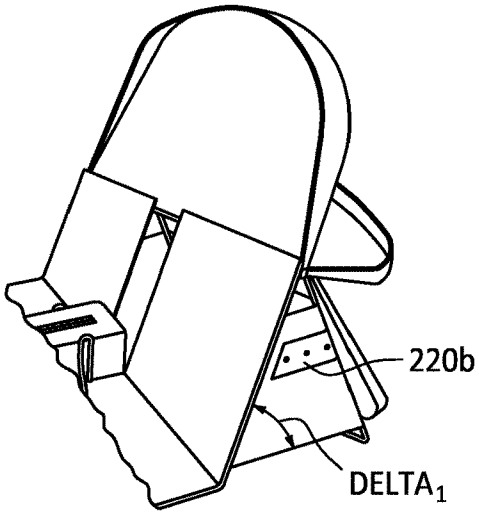
FIGS. 11A-11C are schematic left-side perspective views of the assembly of FIG. 11 showing largest angle, medium angle and smallest angle, respectively.
Figure 11B:
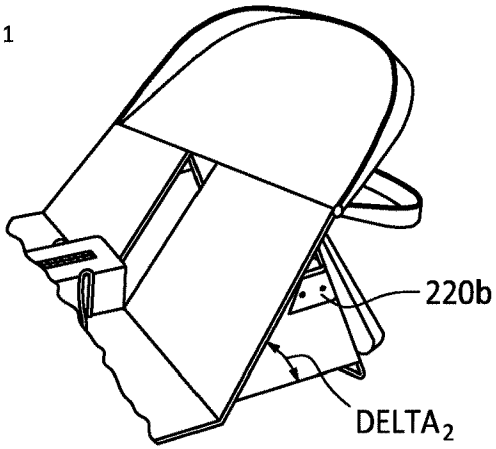
Figure 11C:
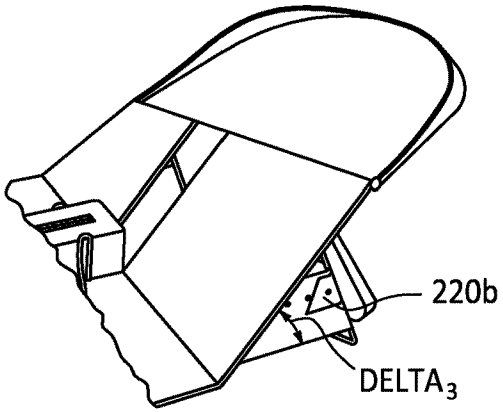
Figure 11:
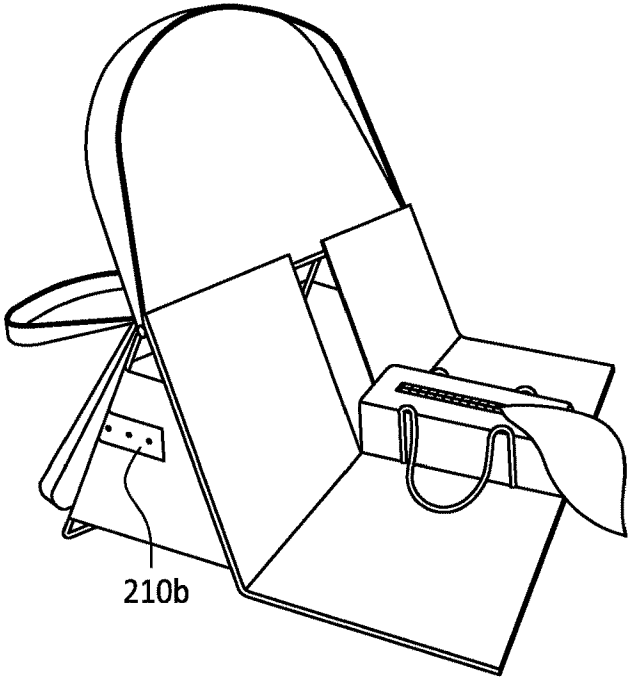
FIG. 11 is a schematic front right-side perspective view of yet another alternative embodiment of a chair assembly with a series of snaps to enable a plurality of deployed angle positions.

FIG. 11 is a schematic front right-side perspective view of yet another alternative embodiment of a chair assembly with a series of snaps on straps 210*b* and 220*b* (FIGS. 11A-11C) to enable a plurality of deployed angle positions. Three different positions 1-3 with corresponding angles $DELTA_1$-$DELTA_3$ are shown in FIGS. 11A-11C, respectively.

Figure 12:
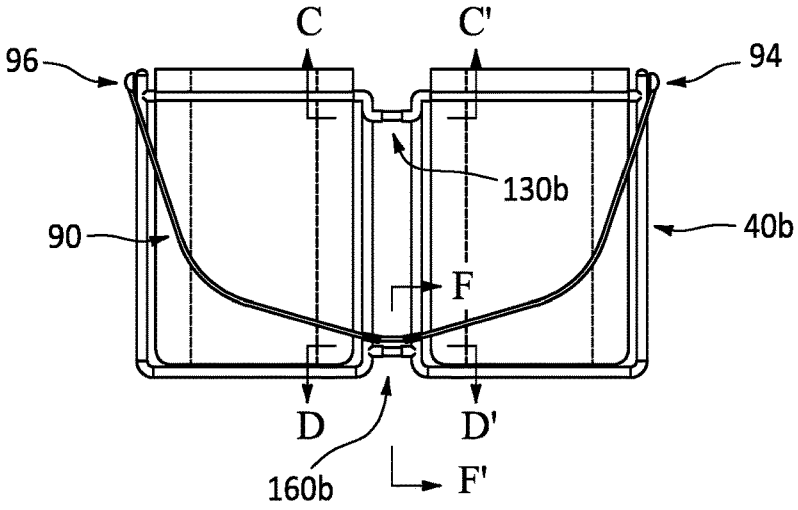
FIG. 12 is a view similar to FIG. 8 designating section lines C-C' and D-D'.
Figure 12A:
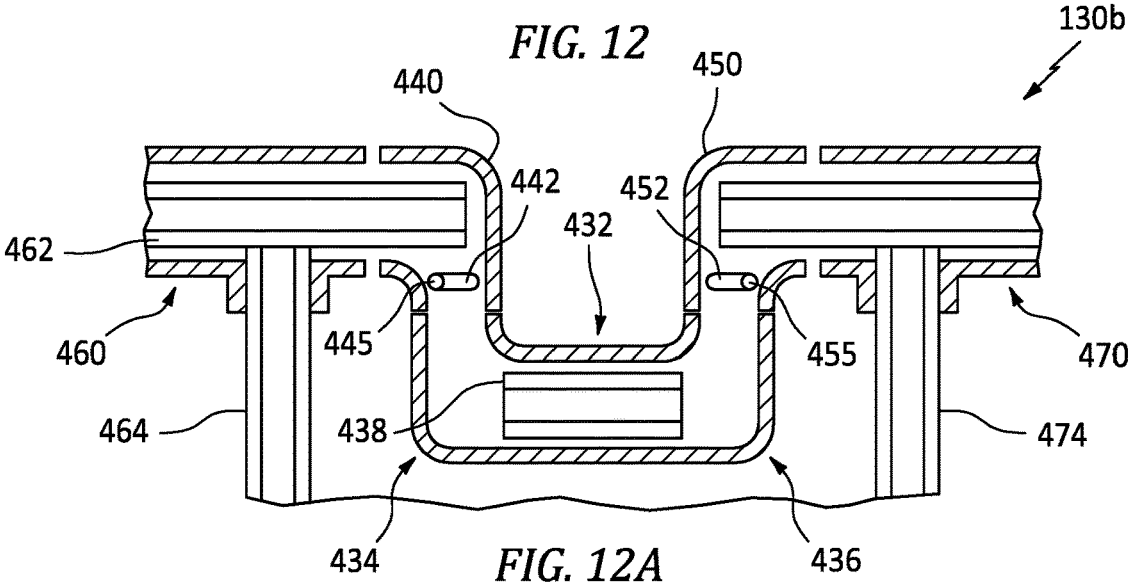
FIGS. 12A and 12B are schematic enlarged cross-sectional views of portions, of the support frame of FIG. 12 along lines C-C' and D-D', respectively.
Figure 12B:
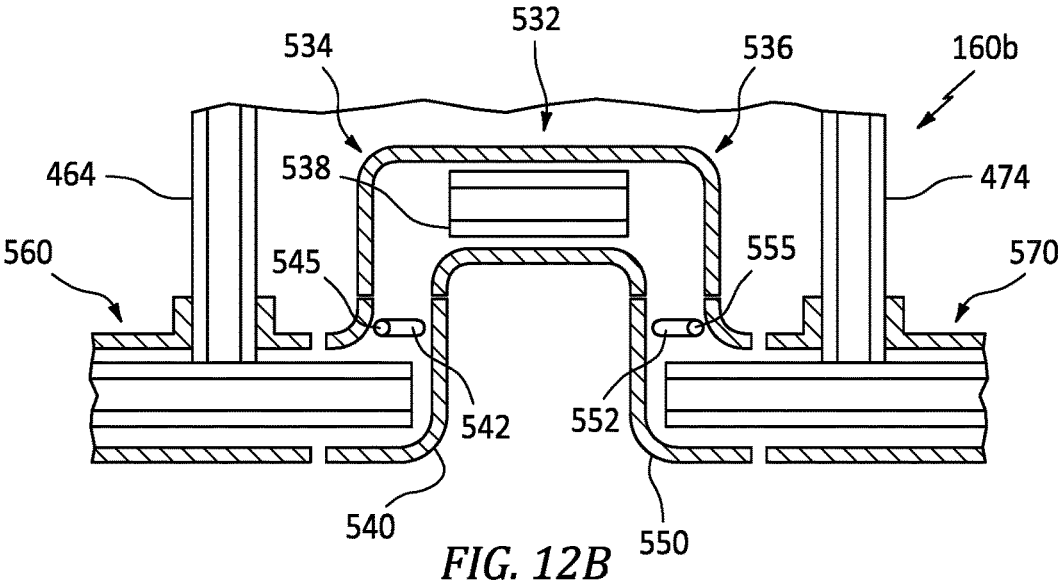
Figure 13:
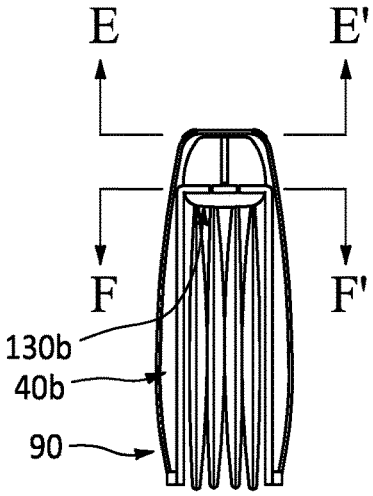
FIG. 13 is a view similar to FIG. 9 designating section lines E-E' and F-F'.
Figure 13A:
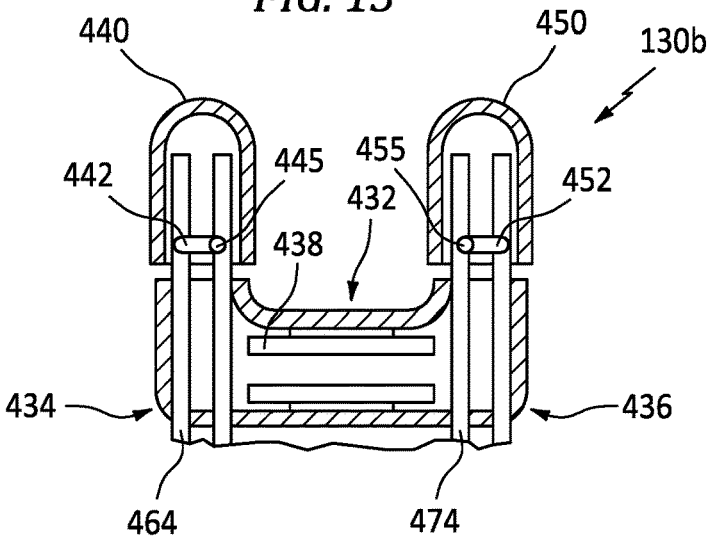
FIGS. 13A and 13B are schematic enlarged cross-sectional views of portions of the support frame of FIG. 13 along lines E-E' and F-F', respectively.
Figure 13B:
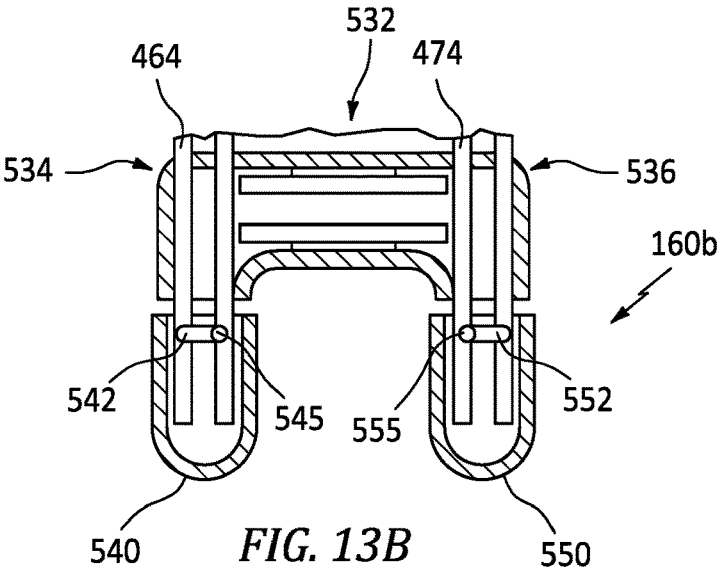

Several constructions of upper frame joint 130 and lower frame joint 160 for support frame 40, FIGS. 1-6D, are shown in more detail in FIGS. 12-15B for support frames 40*b* and 40*c* with rotating elbows in the center sections of the support frames. FIG. 12 is a view similar to FIG. 8 designating section lines C-C' and D-D' through joints 130*b* and 160*b*, respectively, of support frame 40*b*. FIGS. 12A and 12B are schematic enlarged cross-sectional views of portions of the support frame 40*b* of FIG. 12 along lines C-C' and D-D', respectively. Also depicted in FIG. 12 are section lines F-F' through joint 160*b* when the chair assembly is collapsed as shown in FIG. 13, which is a view similar to FIG. 9 designating section line. E-E' and F-F' through joints 130*b* and 160*b*, respectively, of support frame 40*b*. FIGS. 13A and 13B are schematic enlarged cross-sectional views of portions of the support frame of FIG. 13 along lines E-E' and F-F', respectively.

Upper frame joint 130*b*, FIGS. 12A and 13A, has a center section 432 including center elbows 434 and 436 with an inner support tube 438 within first ends of the center elbows 434, 436. Second ends of elbows 434, 436 face elbows 440 and 450 which rotate substantially ninety degrees in this construction relative to center elbows 434, 436. Rotation is limited for joint 130*b* by movement of buttons 445 and 455 within slots 442, 452. Buttons 445 and 455, also referred to herein as "stops" or "stoppers", are fixed projections from tubes 444 and 454, respectively, (not visible in this view) which are fixedly attached to elbows 434 and 436 in this construction.

In another construction, T-pieces 460 and 470 are rotatable as guided by fixed inner tubes 462 and 472, respectively. Similarly, fixed tubes 462, 472 may guide rotation of elbows 440, 450, respectively, in that construction.

Lower frame joint 160*b*, FIGS. 12B and 13B, has a center section 532 including center elbows 534 and 536 with an inner support tube 538. Elbows 540 and 550 rotate substantially ninety degrees in this construction relative to center elbows 534, 536. Rotation is limited for joint 130*b* by movement of buttons 545 and 555 within slots 542, 552. Buttons 545 and 555 are fixed projections from tubes 544 and 554, respectively, (not visible in this view) which are fixedly attached to elbows 534 and 536 in this construction.

In another construction, T-pieces 560 and 570 are rotatable as guided by fixed inner tubes 462 and 472, respectively. Similarly, fixed tubes 462, 472 may guide rotation of elbows 540, 550, respectively, in that construction.

Slots 442, 452 (FIGS. 12A and 13A) and slots 542, 552 (FIGS. 12B and 13B) have arcuate openings encompassing substantially 90 degrees in this construction which enables folding of the chair assembly in only one direction. Slot lengths of substantially 180 degrees or greater enables two different folded positions such as FIG. 6A and/or FIGS. 6B-6D. In yet other constructions, bending joints can be utilized such as described above for hood 90.

Figure 14:
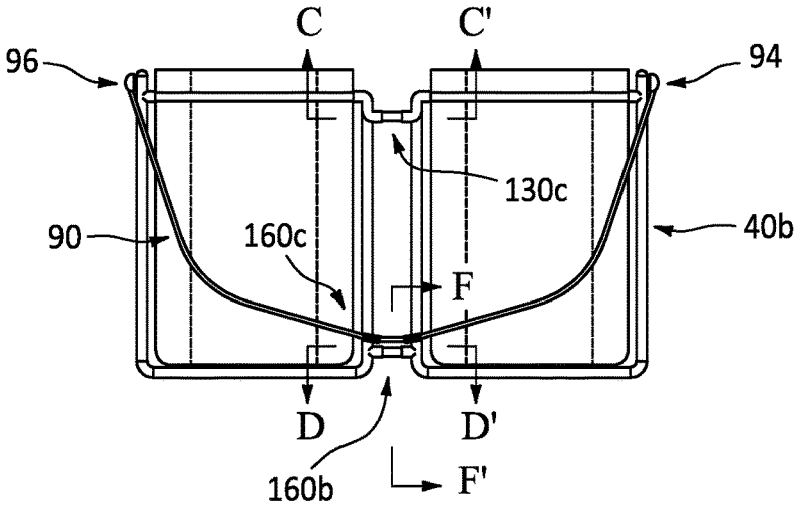
FIGS. 14-15B are views similar to FIGS. 12-13B without button stops.
Figure 14A:
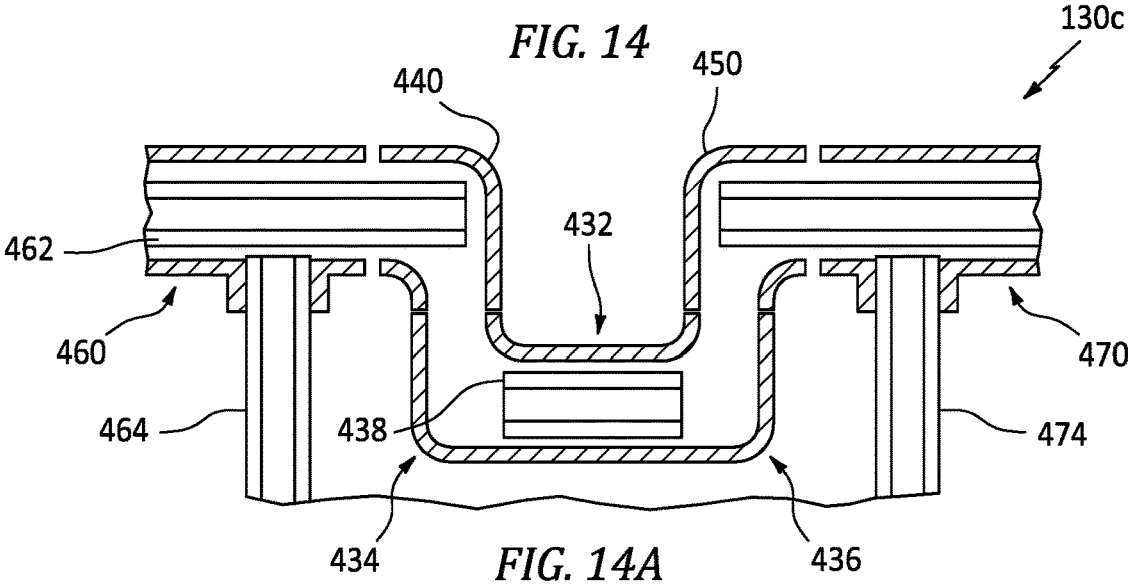
Figure 14B:
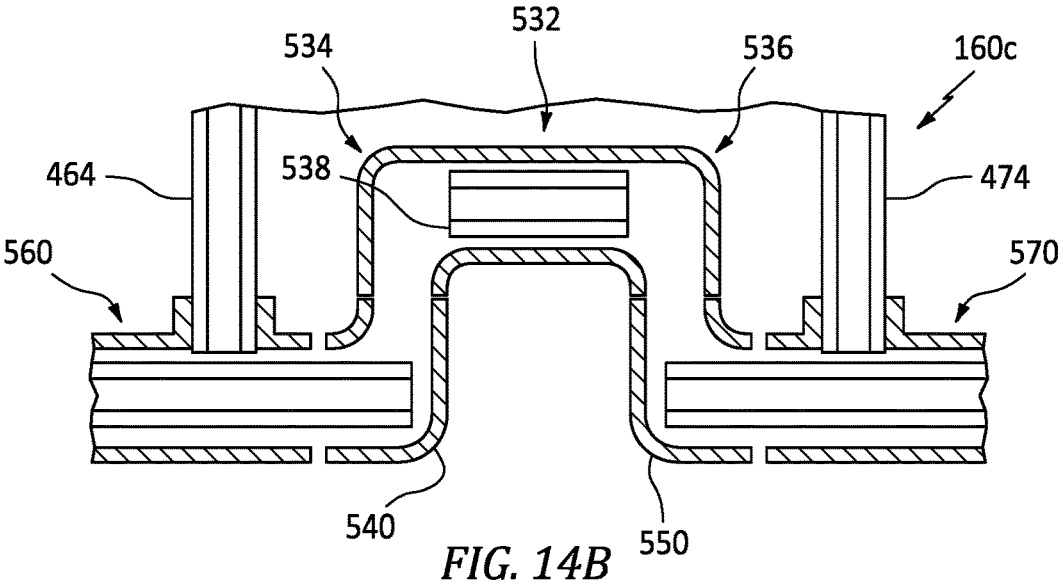
Figure 15:
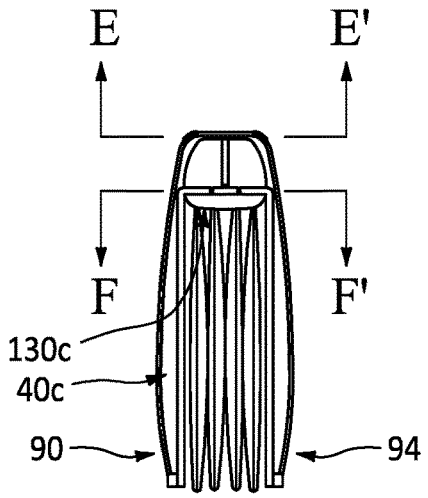
Figure 15A:
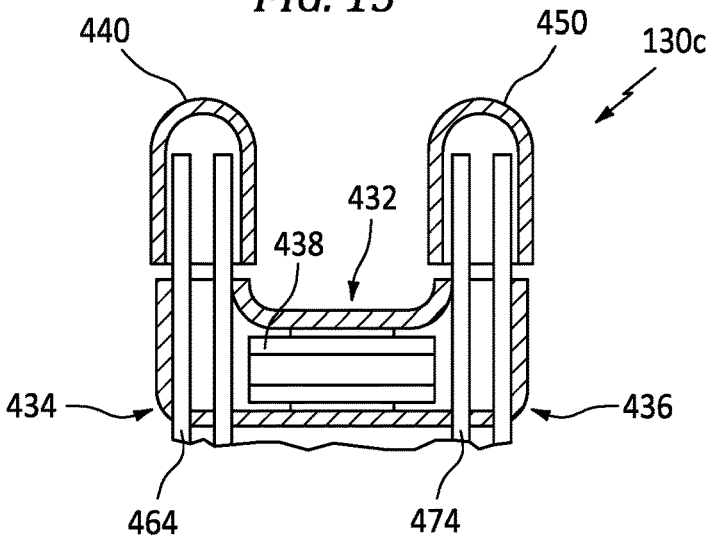
Figure 15B:
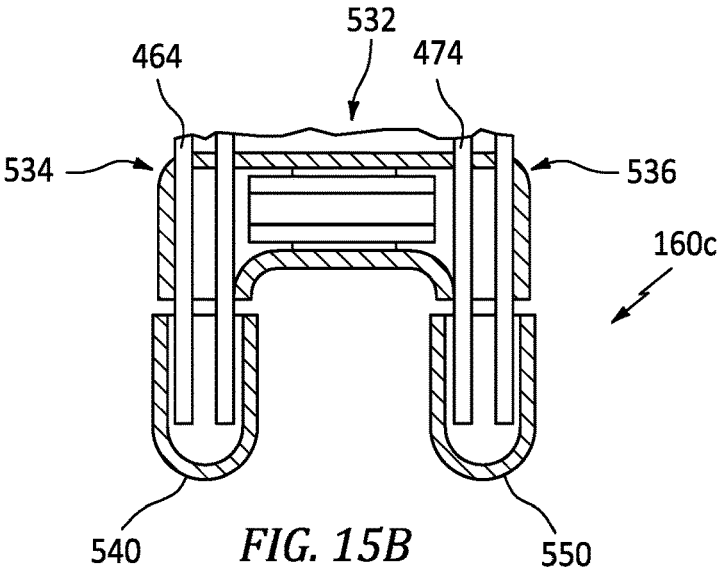

FIGS. 14-15B are views similar to FIGS. 12-13B for joints 130*c* and 160*c* without button stops or other limits for rotation or bending of support frame 40*c*. Upper frame joint 130*c*, FIGS. 14A and 15A, has a center section 432 including center elbows 434 and 436 with an inner support tube 438. Elbows 440 and 450 rotate substantially ninety degrees in this construction relative to center elbows 434, 436. Rotation is not limited for joint 130*c* by movement of buttons within slots. Tubes 544 and 554 (not visible in this view) are fixedly attached to elbows 434 and 436 in this construction Lower frame joint 160*c*, FIGS. 14B and 15B, has a center section 532 including center elbows 534 and 536 with an inner support tube 538. Elbows 540 and 550 rotate substantially ninety degrees in this construction relative to center elbows 534, 536. Rotation is not limited for joint 130*c* by movement of buttons within slots. Tubes 544 and 554 (not visible in this view) are fixedly attached to elbows 534 and 536 in this construction.

Figure 16A:
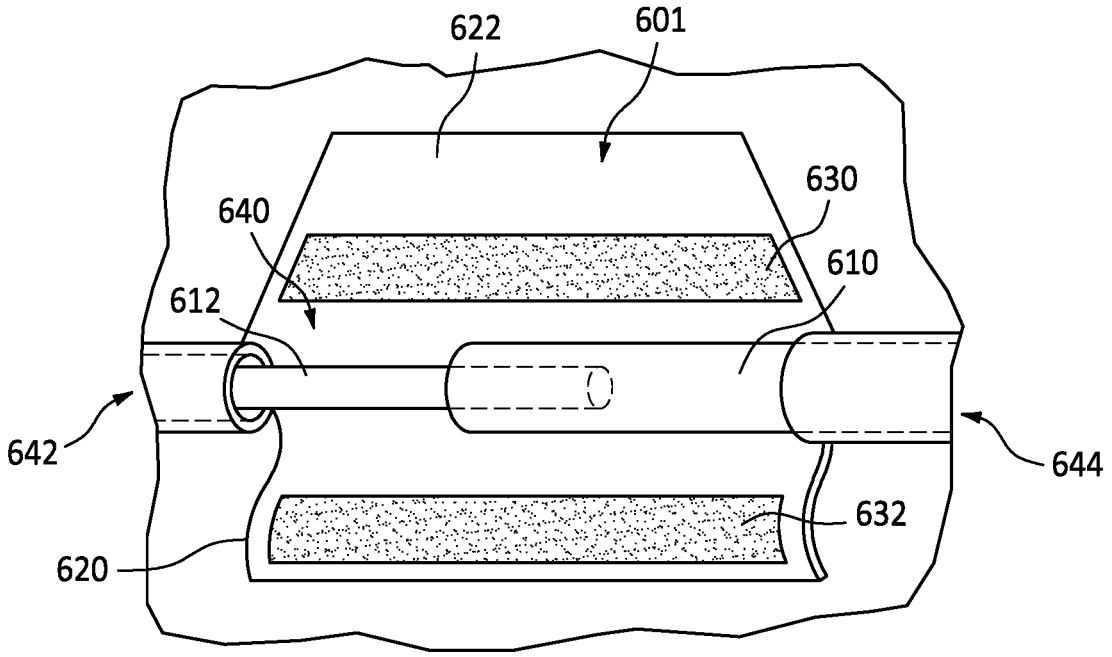
FIG. 16A is schematic perspective view of an alternative hood joint construction having inner and outer tubes.
Figure 16B:
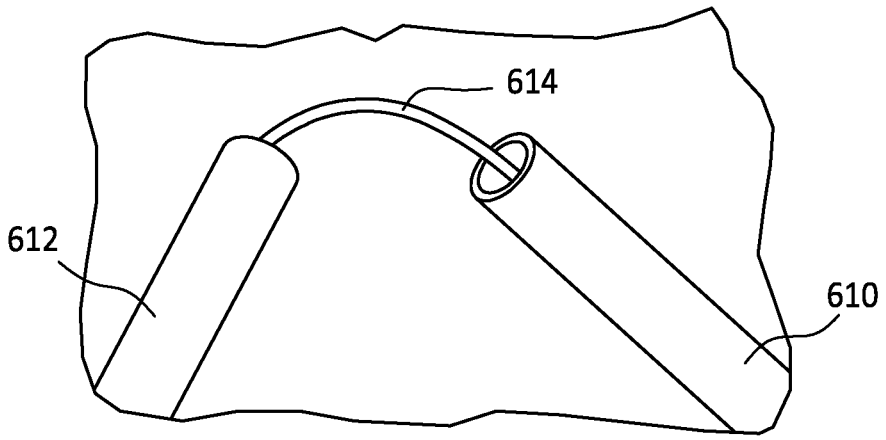
FIG. 16B is an enlarged partial view similar to that of FIG. 16A with the tubes separated from each other.

An alternative hood joint 601, FIGS. 16A-16B, has an outer tube 610, an inner tube 612, and an internal resilient member 614 such as an elastic cord. Inner tube 612 slides within fabric sleeve 642 and outer tube 610 slides within fabric sleeve 644. A fabric section 622 having a flap 620 is connected between sleeves 642 and 644 to form a "pocket" 640. To separate the tubes and expose the resilient member 614 as shown in FIG. 16B, the joint 601 is accessed by a user by pulling on the fabric flap 620 which is secured by matching hook-and-loop strips 630 and 632 to reveal the pocket 640. The hood can then be folded as described above for other constructions. It will be appreciated after reviewing this disclosure that similar joints can be utilized in one or more other locations in which folding or bending is needed during collapsing of portable chair assemblies according to the present invention.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art and are within the following claims.

What is claimed is:

1. A portable chair assembly comprising:

a first chair and a second chair, each chair having a seat and a backrest, each backrest having an upper backrest portion and a lower backrest portion, the backrest being adapted (i) to be folded by a user onto its respective seat in a collapsed position and (ii) to be moved away from that seat into a deployed position such that a person can place at least a portion of his/her back on the backrest for one of the chairs while sitting on the seat for that chair;

a support frame having at least two frame segments, each frame segment having an upper frame portion supporting one of the backrests at pivotable connections with the upper backrest portion of that backrest, and each frame segment being joined to the other frame segment by an upper frame joint member and a lower frame joint member;

at least one angle member per chair, at least one backrest end portion of each angle member secured to one of the first chair backrest and the second chair backrest, and a frame portion of each angle member restricting movement of the support frame away from the seats to establish a maximum deployment angle in the deployed position;

wherein at least one of the angle members includes a loop of fabric having two backrest end portions attached to one of the backrests and a bight of the loop of fabric forming the frame portion of that angle member;

a container having an opening and being positioned between the first chair seat and the second chair seat; and a blanket placeable through the opening into the container to be stored therein in the collapsed position and deployable from the container in the deployed position.

2. The assembly of claim 1 wherein each angle member is adjustable to change the maximum deployment angle.

3. The assembly of claim 1 further including at least one carry strap extending proximate to the carry case to enable a user to carry the assembly in the collapsed position utilizing the at least one carry strap.

4. The assembly of claim 1 wherein the container is attached to an edge of each of the first chair seat and the second chair seat.

5. The assembly of claim 1 wherein the container is one of (i) a carrying case formed of fabric with a zipper closure over the opening or (ii) a stuff sack.

6. The assembly of claim 1 wherein the lower backrest portion of each backrest for each chair is bendably attached to a portion of the seat for that chair.

7. The assembly of claim 1 wherein a majority of each of the chairs is formed of a flexible fabric.

8. The assembly of claim 1 wherein the upper and lower frame joint members enable each frame segment to be folded to occupy a plane that is substantially parallel to a plane occupied by the other frame segment.

9. The assembly of claim 8 wherein the frame joint members establish a center frame span having a center frame length, and the container has a width that is substantially the same as the center frame length.

10. The assembly of claim 1 further including a hood having material extending between a front hood frame member and a rear hood frame member, each of the front hood frame member and the rear hood frame member having at least one joint to enable bending of the hood between a deployed hood condition and a collapsed hood condition.

11. The assembly of claim 10 wherein each of the front hood frame member and the rear hood frame member has a center hood joint, a left-side hood joint and a right-side hood joint, and each of the front hood frame member and the rear hood frame member being pivotably connected to each of the frame segments.

12. A portable chair and sunshade assembly comprising:

a first chair and a second chair, each chair having a seat and a backrest, each backrest having an upper backrest portion and a lower backrest portion, the backrest being adapted (i) to be folded by a user onto its respective seat in a collapsed position and (ii) to be moved away from that seat into a deployed position such that a person can place at least a portion of his/her back on the backrest for one of the chairs while sitting on the seat for that chair;

a support frame having at least two frame segments, each frame segment having an upper frame portion supporting one of the backrests at pivotable connections with the upper backrest portion of that backrest, and each frame segment being joined to the other frame segment by an upper frame joint member and a lower frame joint member, wherein the upper and lower frame joint members enable each frame segment to be folded to occupy a plane that is substantially parallel to a plane occupied by the other frame segment;

at least two angle members per chair, first and second backrest end portions of each angle member secured to one of the first chair backrest and the second chair backrest, and a frame portion of each angle member restricting movement of the support frame away from the seats to establish a maximum deployment angle in the deployed position;

wherein at least one of the angle members includes a loop of fabric having two backrest end portions attached to one of the backrests and a bight of the loop of fabric forming the frame portion of that angle member;

a hood having material extending between a front hood frame member and a rear hood frame member, each hood frame member having at least one joint, each hood frame member being pivotably connected to each of the frame segments, and each hood frame member adapted to be moved between a deployed hood condition and a collapsed hood condition;

a container having an opening and being positioned between the first chair seat and the second chair seat;

at least one carry strap extending proximate to the carry case to enable a user to carry the assembly in the collapsed position utilizing the at least one carry strap; and a blanket placeable through the opening into the container to be stored therein in the collapsed position and deployable from the container in the deployed position.

13. The assembly of claim 12 further including at least two carry straps extending proximate to the carry case to enable a user to carry the assembly in the collapsed position utilizing the carry straps.

14. The assembly of claim 12 wherein the lower backrest portion of each backrest for each chair is bendably attached to a portion of the seat for that chair.

15. The assembly of claim 12 wherein the frame joint members establish a center frame span having a center frame length, and the container has a width that is substantially the same as the center frame length.

* * * * *